US005220903A

United States Patent [19]

Niemetz

[11] Patent Number: 5,220,903

[45] Date of Patent: Jun. 22, 1993

[54] ELECTRONIC IGNITION SYSTEM

[75] Inventor: Linhard Niemetz, Rednitzhembach, Fed. Rep. of Germany

[73] Assignee: TELEFUNKEN Electronic GmbH, Heilbronn, Fed. Rep. of Germany

[21] Appl. No.: 783,158

[22] Filed: Oct. 28, 1991

[30] Foreign Application Priority Data

Dec. 1, 1990 [DE] Fed. Rep. of Germany ..... 4038440

[51] Int. Cl.[5] ..... F02P 3/04

[52] U.S. Cl. ..... 123/651; 123/656

[58] Field of Search ..... 123/609, 610, 625, 629, 123/651, 656

[56] References Cited

U.S. PATENT DOCUMENTS 4,176,644 12/1979 Hellberg et al. ..... 123/625
4,406,273 9/1983 Yoshinaga et al. ..... 123/625
4,408,592 10/1983 Yoshinaga et al. ..... 123/625
4,421,091 12/1983 Kawai et al. ..... 123/625 X

FOREIGN PATENT DOCUMENTS 2759154 7/1979 Fed. Rep. of Germany .
2833477 2/1980 Fed. Rep. of Germany .
2500074 8/1982 France .

OTHER PUBLICATIONS

JP 56-135755 A. In: Patents Abstracts of Japan, M-109, Jan. 30th, 1982, vol. 6, No. 17.

*Primary Examiner*—Tony M. Argenbright
*Attorney, Agent, or Firm*—Spencer, Frank & Schneider

[57] ABSTRACT

An electronic ignition system having a control unit to preset the ignition times of the individual cylinders, an ignition coil, and an end stage with a switching transistor ($T_1$) for exciting the ignition coil. The end stage is provided with a switching unit with which the sparking cycle of the spark plugs is influenced.

17 Claims, 3 Drawing Sheets t
$U_{ST}$
$U_{Pr}$
$U_B$
$-U_{Br}$
$-I_{Br}$
$I_F$
$\Delta U$
$t_{Br}$
2ms
$t_Z$

ELECTRONIC IGNITION SYSTEM

BACKGROUND OF THE INVENTION

In electronic ignition systems, ignition coils are excited via a pickup and a control unit using switching transistors, with the coils generating the ignition voltage or ignition current. Older ignition systems with simple ignition employ a distributor to allocate the ignition voltage mechanically to the individual cylinders, whereas in modern ignition systems the cylinders are directly supplied, i.e., without mechanical distributors.

To improve the cold-starting characteristics of the engine, a high ignition energy of the ignition coil is needed for the ignition process; this generally ensures—even when the spark plug is dirty, causing a low-resistance shunt through which part of the ignition energy flows out of the ignition coil—that an ignition spark is generated between the spark plug electrodes.

As a result of this high ignition energy—which is actually not even necessary once the engine has warmed up—the useful life of the spark plugs is greatly shortened. To increase the interval between changes of the spark plugs—for example, from 20,000 kilometers to 50,000 or 100,000—improved spark plugs can be used, which however are very expensive.

SUMMARY OF THE INVENTION

The object underlying the invention is to provide an electronic ignition system that permits a prolongation of the spark plug's useful life and that can be manufactured inexpensively and in large numbers. This object is attained by an electronic ignition system having a control unit to preset the ignition times of the individual cylinders, an ignition coil and an end stage with a switching transistor for exciting the ignition coil, and wherein a switching unit, which is responsive to an input control signal, is provided in the end stage for influencing the length of the sparking cycle of the spark plugs. More particularly, according to the present invention the sparking cycle can be shortened from a maximum normal cycle time to variable desired cycle times which can be selected independent of the motor parameters. Moreover, according to the preferred embodiment of the invention, the switching unit includes a circuit arrangement for utilizing the voltage increase occurring at the primary winding of the ignition coil to control the switching unit to terminate the sparking process when shortening is required in response to a control signal, and for deactivation of control unit and permit normal unshortened operation of the ignition system if the control signal should be absent, e.g., due to a malfunction of the unit providing the control signal.

The sparking cycle or sparking time of the spark plugs—during which a light arc is maintained between the spark plug electrodes—can be varied on the basis of a sparking time preset using the control unit in the ignition system in accordance with the invention.

In particular, the maximum sparking cycle can be preset for attempted cold-starts, while the duration is reduced when the engine is already running; for this reason, a high-energy or shunt-insensitive ignitor can also be used without its detrimental effects acting on the spark plug's useful life. The required or necessary sparking cycle of the spark plugs can be determined or set as a function of engine parameters and is transmitted by the control unit to the end stage.

In the end stage, a switching unit having a switch is provided to influence the sparking cycle, and is used to short-circuit the primary winding of the ignition coil after expiry of the sparking cycle preset by the control unit; as a result, the ignition spark between the spark plug electrodes is put out and the sparking cycle ended. This creates in the switching unit a free-wheeling current, by which the energy stored in the ignition coil is dissipated, with an energy quantity being the greater the more the preset sparking cycle is reduced in relation to the maximum sparking cycle. The switch of the switching unit can be in the form of transistors or thyristors, for example, with n-p-n transistors, p-n-p transistors, IGBT transistors and field-effect transistors being suitable; the transistors can also be Darlington or triple transistors.

BRIEF DESCRIPTION OF THE DRAWINGS

The invention is described in detail in the following on the basis of FIGS. 1 to 4. In the Figures.

DESCRIPTION OF A PREFERRED EMBODIMENT

Figure 1:
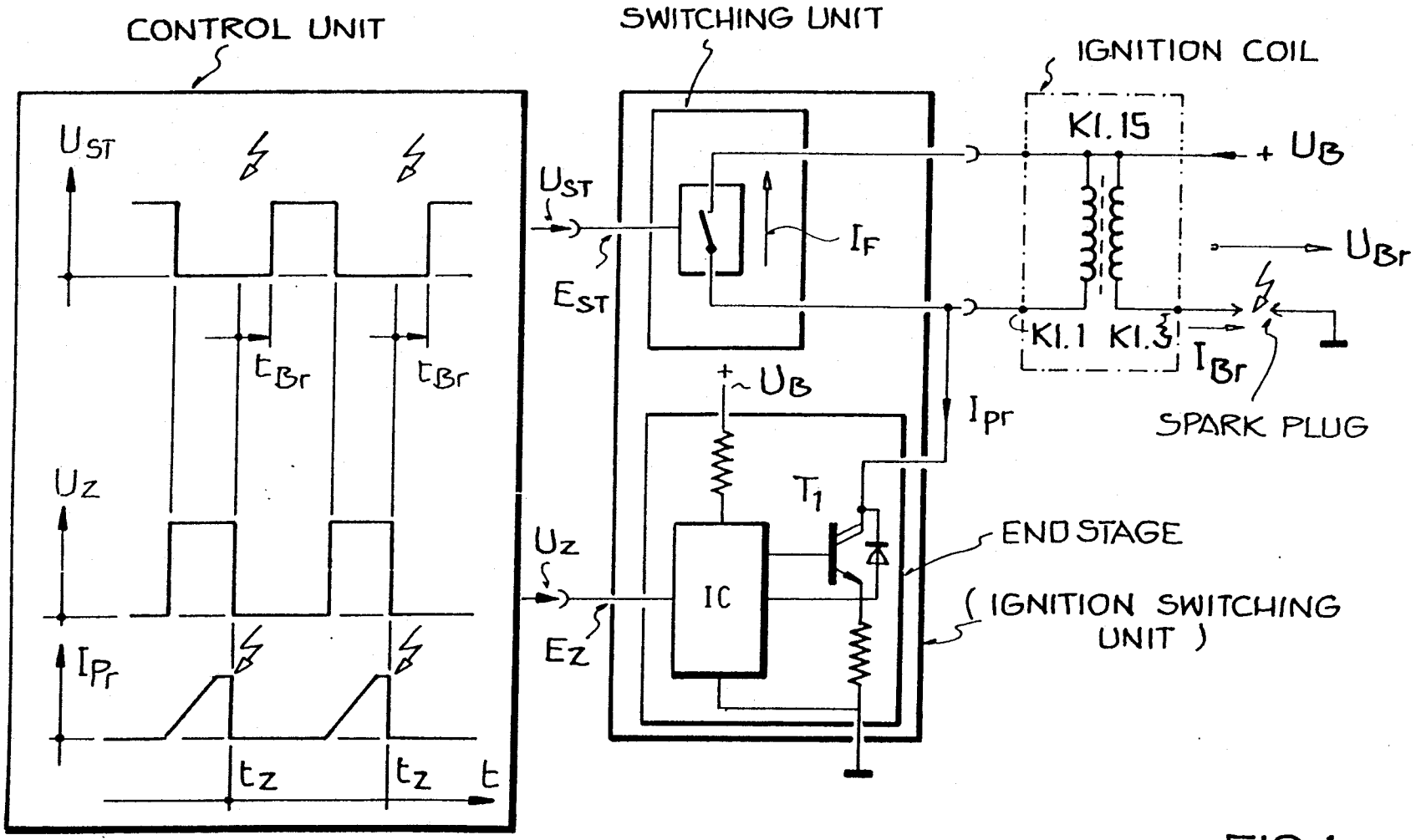
FIG. 1 shows a basic wiring diagram of an electronic ignition system, FIGS. 2(*a–e*) show the signal time curves at maximum sparking cycle, FIGS. 3(*a–e*) show the signal time curves with shortened sparking cycle.

FIG. 1 is a block diagram showing an electronic ignition system for a motor vehicle.

The control unit controls the timing of the ignition or ignition times $t_z$ by switching the ignition coil on and off, the timing of the current flow $I_{Pr}$ through the primary winding of the ignition coil being preset using the switching edges $U_Z$ at the ignition input $E_Z$ of the end stage. In addition, a control signal $U_{st}$ for the sparking cycle $t_{Br}$ dependent on motor parameters such as petrol/air mixture, speed, engine temperature and engine load—is preset at the control input $E_{st}$ of the switching unit of the end stage. The end stage has, in addition to the ignition switching unit (which has an ignition IC and the end stage transistor $T_1$ for controlling the ignition stage, the ignition IC serving to regulate the end stage transistor) a switching unit too, by which the secondary winding sparking cycle is controlled on the primary winding of the ignition coil. The ignition coil is operated by the transistor $T_1$; on the secondary winding of the ignition coil, the individual cylinders are allocated to the coil, with or without distributor, via the spark plugs (terminal K1.3), with the sparking voltage $U_{Br}$ being applied via the spark plugs and the sparking current $I_{Br}$ flowing through the spark plugs. The primary winding of the ignition coil is on the other hand connected via terminal K1.15 to the operating voltage $U_B$, while the collector voltage of the ignition transistor $T_1$ is applied to terminal K1.1.

Figures 2A, 2B, 2C, 2D, 2E, 3A, 3B, 3C, 3D, 3E:
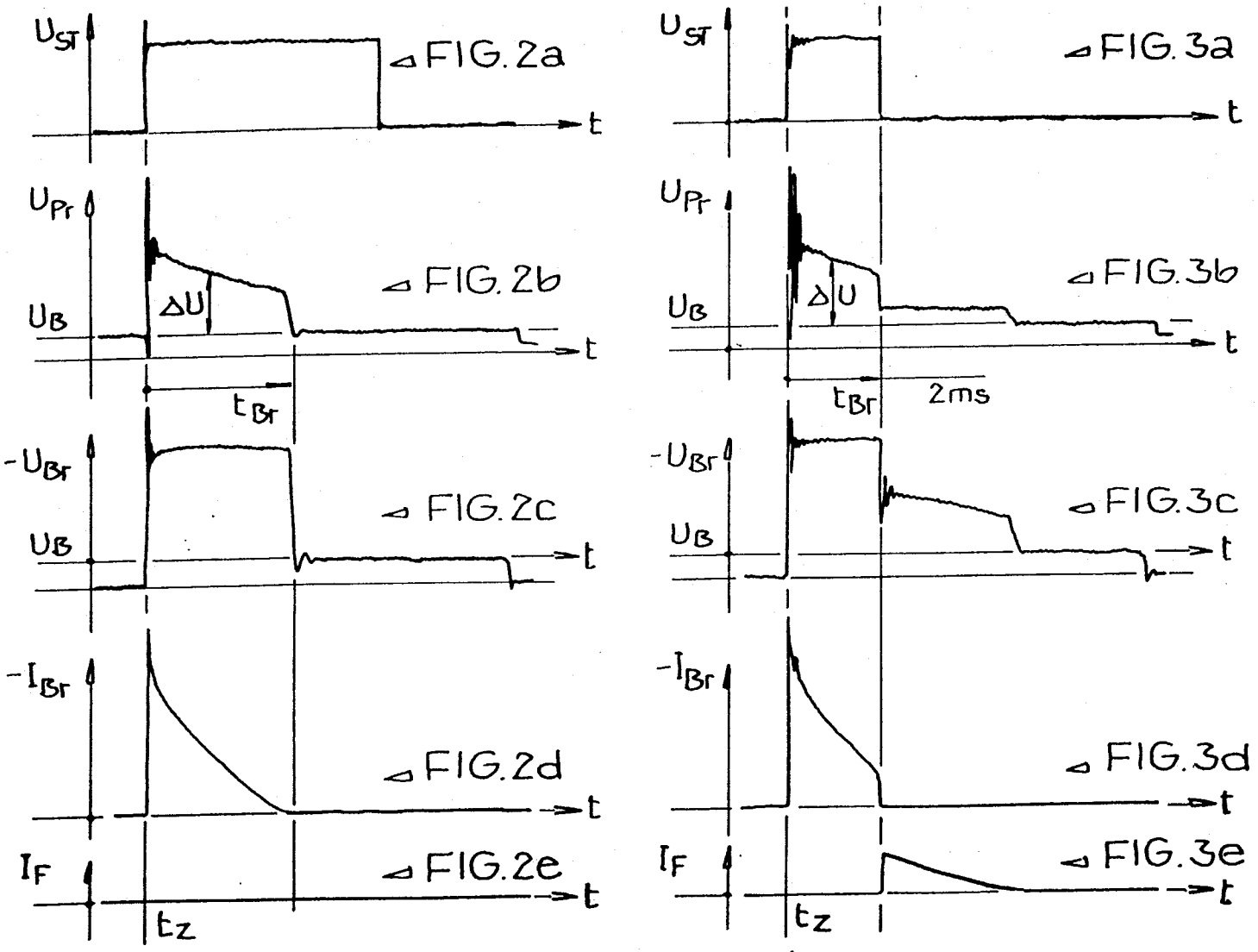

FIG. 2 shows the timing of the signals for ignition with the highest possible sparking time, where FIGS. 2*a* to 2*e* show the control signal for the sparking cycle (control voltage $U_{st}$), the voltage on the primary of the ignition coil ($U_{Pr}$), the voltage on the secondary of the ignition coil (sparking voltage $U_{Br}$), the current on the secondary of the ignition coil (sparking current $I_{Br}$), and the free-wheeling current ($I_F$) in the switching unit.

In accordance with FIG. 2*a*, the control signal preset by the control unit and determining the sparking cycle is longer than the maximum sparking cycle, so that a "normal" ignition cycle with an unshortened sparking cycle $t_{Br}$ of, for example, 3 ms is obtained, as is necessary in cold starting, for example:

the switching transistor $T_1$ is controlled by the switching edges $U_Z$ generated in the control unit, where the current flow through the ignition coil is interrupted when the transistor is switched off, and an induction voltage is induced on the primary of the ignition coil.

the voltage rise on the primary of the ignition coil—the primary voltage $U_{Pr}$ or backfire voltage shown in FIG. 2*b*, which can be 380 to 400 V, for example—is transmitted by induction to the secondary of the ignition coil.

If the induction voltage rise on the secondary has risen to a certain value (for example 20 kV), ignition takes place by a spark discharge between the spark plug electrodes (ignition time $t_Z$); as a result, the voltage drops on the secondary from 20 kV to approx. 400 V—this is the so-called sparking voltage $U_{Br}$ (FIG. 2*c*).

the energy stored in the ignition coil during the charging process determines the sparking time or sparking cycle $t_{Br}$; the sparking current $I_{Br}$ (FIG. 2*d*) flows and the light arc between the spark plug electrodes (sparking voltage $U_{Br}$) is maintained until the stored energy has been used up or has been converted in the spark plugs.

after the end of the ignition process, the backfire voltage on the primary (Fig. 2*b*) drops from its maximum value (380–400 V) to the operating voltage $U_B$ (for example 12 V).

since the switching unit of the end stage was not activated during the sparking time, no free-wheeling current $I_F$ flows, in accordance with FIG. 2*e*.

FIG. 3 shows, corresponding to FIG. 2, the signal timing for ignition with shortened sparking time, with the values in FIGS. 3*a* to 3*e* being plotted to correspond to the values in FIGS. 2*a*–2*e*.

The control signal preset by the control unit (control voltage $U_{st}$) changes as shown in FIG. 3*a*, after only 2 ms, for example—i.e. before the expiry of the highest possible sparking time of 3 ms, for example—from the "HIGH" level to the "LOW" level, and thereby activates the switching unit of the end stage that short-circuits the primary of the ignition coil:

in accordance with FIG. 3*b*, the primary voltage $U_{Pr}$ drops significantly as a result the sparking voltage $U_{Br}$ is reduced in accordance with FIG. 3*c* to a value that is no longer sufficient to maintain the spark discharge between the spark plug electrodes, and the sparking process is ended the sparking current $I_{Br}$ tends towards 0 mA directly after activation of the switching unit, in accordance with FIG. 3*d* the free-wheeling current $I_F$ through the switching unit (FIG. 3*e*) flows until the energy stored in the coil has been dissipated; the shorter the preset sparking time, the more energy has to be used up. The amount of the free-wheeling current $I_F$ accordingly depends on the point at which the switching unit is activated; its maximum value can be as high as the primary current with which the coil was charged ($t_{Br}=0$). With an increasing sparking cycle, $I_F$ drops, as part of the stored energy has already been converted in the spark plug.

Figure 4:
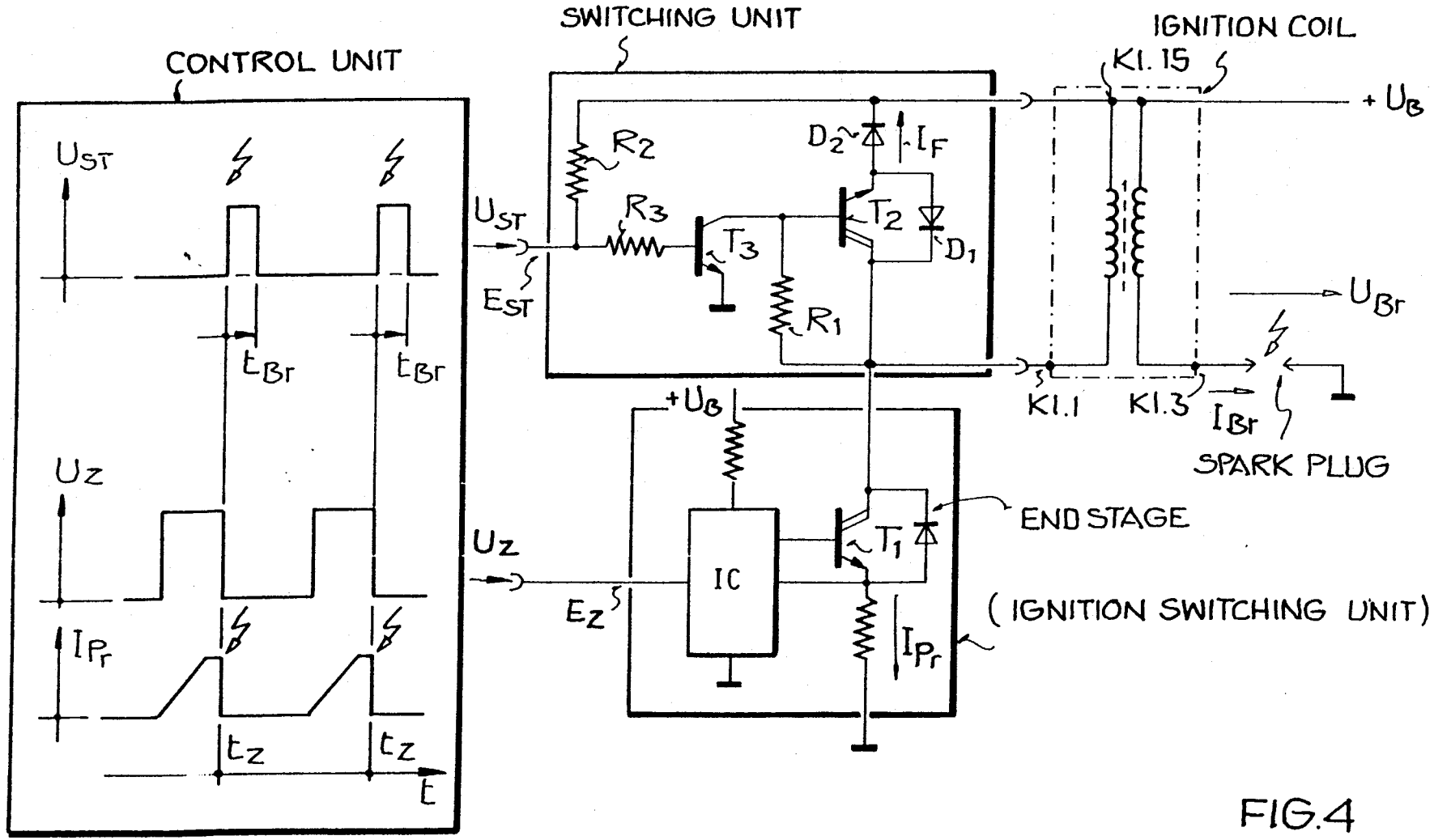
FIG. 4 shows the detailed wiring diagram of an embodiment of the circuit section of the end stage.

FIG. 4 shows an embodiment of the switching unit in which the switch is an n-p-n transistor $T_2$.

The switching unit contains, in addition to the switching transistor $T_2$, the driver transistor $T_3$, the resistors $R_1$ to $R_3$, and the diodes $D_1$ and $D_2$. The resistor $R_1$ is used to bias the transistor $T_2$, the resistor $R_2$ as a protective measure in the event of defects, and the resistor $R_3$ to drive the transistor $T_3$. The diode $D_1$ is a protective diode for the transistor $T_2$. The diode $D_2$ prevents an unwanted current flow from terminal K1.15 through diode $D_1$ to transistor $T_1$ at the point at which the primary of the ignition coil is to be charged by switch-on of the transistor $T_1$; in addition, positive voltage peaks are thereby kept away from the supply line by the emitter of the transistor $T_2$. The transistor $T_2$ is designed, for example, as a Darlington transistor whose emitter is connected (terminal K1.15) to the operating voltage $U_B$ via diode $D_2$ and whose collectors, which form the output of the switching unit, are connected to terminal K1.1 of the ignition coil. The base of the transistor $T_2$ is connected to the collector of the transistor $T_3$, whose emitter is connected to reference potential. The resistor $R_3$ is connected to the base of the transistor $T_3$, and the resistor $R_2$ to the operating voltage VB, with the second connections of resistors $R_2$ and $R_3$ forming the control input $E_{st}$ of the switching unit, to which input the control voltage $U_{st}$ or the control signal of the control unit is applied.

Since the motor vehicle usually only has a single operating voltage $U_B$ (normally 12 V), thus presenting problems for the triggering of transistor $T_2$, the voltage increase $\Delta U$ of terminal K1.1—caused by induction processes—in relation to terminal K1.15 on the primary of the coil during the sparking time $t_{Br}$ (cf. FIGS. 2*b*/3*b*) is used to trigger the transistor $T_2$. The base current for the transistor $T_2$ is determined by the voltage increase $\Delta U$ and the resistor $R_1$, and the collector current or free-wheeling current is determined by the base current amplification factor.

During the required sparking time, the control signal $U_{st}$ at the switch input $E_{st}$ is at HIGH potential—the transistor $T_3$ becomes conductive and thereby blocks the transistor $T_2$; the switching unit is therefore inactive. When the preset sparking time is reached, the control input $E_{st}$ is switched to chassis—the control voltage $U_{st}$ goes to LOW potential—and the transistor $T_3$ blocks; the voltage increase $\Delta U$ at terminal K1.1 during the sparking time in relation to that at terminal K1.15 makes the transistor $T_2$ conductive via the resistor $R_1$, so that the primary of the ignition coil is short-circuited, the sparking process broken off, and the energy stored in the ignition coil dissipated by the free-wheeling current $I_F$. The required sparking cycle can be preset to any value by the electronic control, and ranges from the time $t_{Br}=0$ (no ignition) to the maximum possible sparking time.

In the event that no control voltage $U_{st}$ is applied to the control input $E_{st}$ due to a defect (for example a break in the $E_{st}$ cable), the transistor $T_3$ remains blocked and the switching unit would be activated—which is not desirable—in every ignition operation directly after the ignition time, and would terminate the sparking cycle immediately. To prevent this, the pull-up resistor $R_2$ is provided, that supplies the operating voltage $U_B$ to the base of the transistor $T_3$ so that the latter is activated when there is no control voltage $U_{st}$; this deactivates the switching unit, and an unshortened ignition operation with the maximum sparking time is rendered possible.

The switch of the switching unit can be provided in a different way in addition to the embodiment described above. For example, the switch can be a p-n-p transistor, an IGBT transistor or field-effect transistor, and thyristors can also be used. The transistors can, for example, be designed as Darlington transistors or triple transistors with a high current amplification.

In addition, it is possible to provide the switching unit with protective measures or protective elements against the disturbing voltages usual in motor vehicles.

What is claimed is:

1. In an electronic ignition system including a control unit for providing first and second control signals to preset the ignition times of the individual cylinders and the sparking cycle for the spark plugs of the cylinders, an ignition coil, and an end stage including a switching transistor, responsive to said first control signal, for exciting said ignition coil and a switching unit, responsive to said second control signals, for shortening the sparking cycle of the spark plugs, the improvement wherein said switching unit includes circuit means, responsive to said second control signals, for shortening the sparking cycle to a selected variable value determined by said second control signals.

2. An ignition system according to claim 1, wherein said circuit means of said switching unit contains a switch that is connected to close and short-circuit the primary winding of said ignition coil in response to said second control signals as a function of the sparking cycle preset by said control unit, causing said sparking cycle of said spark plugs to be terminated, and to generate a free-wheeling current in said switching unit when said switch is closed, by which energy stored in said ignition coil is dissipated.

3. An ignition system according to claim 2, wherein said switch of said switching unit is one of a transistor and a thyristor.

4. An ignition system according to claim 3, wherein said switch is a bipolar transistor.

5. An ignition system according to claim 4, wherein said bipolar transistor is an n-p-n transistor whose collector is connected to a first terminal of said primary winding of said ignition coil and whose emitter is connected to a second terminal of said primary winding said ignition coil; wherein the collector of a driver transistor is connected to the base of said bipolar transistor; and wherein the base of said driver transistor is connected to a control output of said control unit providing said second control signal.

6. An ignition system according to claim 5, wherein a resistor is connected between said second terminal of said primary winding of said ignition coil and the base of said bipolar transistor.

7. An ignition system according to claim 6, wherein the second control voltage signal at said control output of said control unit is supplied to the base of said driver transistor via a control input and a second resistor; wherein said control input is connected by a third resistor to said second terminal of said ignition coil; and wherein a diode is disposed between the emitter of said bipolar transistor and said second terminal of said ignition coil.

8. An ignition system according to claim 4, wherein said bipolar transistor has a plurality of connected collector electrodes.

9. An ignition system according to claim 1, wherein said switching transistor is a bipolar transistor having its emitter-collector path connected in series with the primary winding of said ignition coil across a source of operation voltage and its base connected to receiving a signal corresponding to said first control signals.

10. An electronic ignition system comprising:

an ignition coil having a primary winding connected between a first terminal connectable to an operating voltage source and a second terminal, and a secondary winding connected between said first terminal and a third terminal connectable to at least one spark plug; a first controllable switch connected in series with said primary winding between said second terminal and a point of reference potential; a second controllable switch connected between said first and second terminals and in parallel with said primary winding; an control unit for producing first and second control voltages for controlling the ignition time for a spark plug and the sparking cycle of a spark plug, respectively; first circuit means for supplying said first control voltage to a control input of said first controllable switch to control its opening and closing; and second circuit means for supplying said second control voltages to a control input of said second controllable switch to control its opening and closing in a variable manner corresponding to the length of said second control voltage.

11. An electronic ignition system according to claim 10, further comprising a first resistor connected between said control input of said second controllable switch and said second terminal of said ignition coil.

12. An electronic ignition system according to claim 11, wherein said second controllable switch is a bipolar switching transistor having its emitter-collector path connected between said first and second terminals of said ignition coil, and its base, which constitutes said control input, connected to said first resistor and to an output of said second circuit means.

13. An electronic ignition system according to claim 12, wherein said second circuit means comprises a driver transistor having its emitter-collector path connected between said base of said switching transistor and said point of reference potential, and its base connected to an input terminal for receiving said second control voltage.

14. An electronic ignition system according to claim 13, further comprising a second resistor connector between said input terminal and said first terminal of said ignition coil.

15. An electronic ignition system according to claim 14, wherein said base of said driver transistor is connected to said input terminal via a third resistor.

16. An electronic ignition system according to claim 14, wherein said switching transistor is an n-p-n transistor having its emitter connected to said first terminal of said ignition coil via a diode.

17. An electronic ignition system according to claim 16, wherein said driver transistor is an n-p-n transistor having its emitter connected to said base of said switching transistor.

* * * * *